US008624783B2

(12) United States Patent
Kim et al.

(10) Patent No.: US 8,624,783 B2
(45) Date of Patent: Jan. 7, 2014

(54) INTERNAL ANTENNA MODULE AND WIRELESS COMMUNICATION APPARATUS HAVING THE SAME

(75) Inventors: Sung Won Kim, Seoul (KR); Jae Sun Park, Gyeonggi-do (KR); Jae Min Seo, Gyeonggi-do (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 477 days.

(21) Appl. No.: 12/631,994

(22) Filed: Dec. 7, 2009

(65) Prior Publication Data

US 2010/0141537 A1 Jun. 10, 2010

(30) Foreign Application Priority Data

Dec. 8, 2008 (KR) ..... 10-2008-0123750

(51) Int. Cl.
*H01Q 1/38* (2006.01)

(52) U.S. Cl.
USPC ..... 343/700 MS; 343/702

(58) Field of Classification Search
USPC ..... 343/700 MS, 702
See application file for complete search history.

(56) References Cited

U.S. PATENT DOCUMENTS

| | | | | |
|---|---|---|---|---|
| 5,646,633 | A * | 7/1997 | Dahlberg | 343/700 MS |
| 6,992,628 | B2 * | 1/2006 | Rawnick et al. | 343/700 MS |
| 2006/0284773 | A1 * | 12/2006 | Park et al. | 343/702 |
| 2007/0040755 | A1 * | 2/2007 | Na et al. | 343/702 |
| 2007/0057850 | A1 * | 3/2007 | Yang | 343/700 MS |

* cited by examiner

*Primary Examiner* — Dieu H Duong
(74) *Attorney, Agent, or Firm* — Cha & Reiter, LLC

(57) ABSTRACT

An internal antenna module and a wireless communication apparatus having the same are disclosed. The internal antenna module includes a carrier having a partition formed on a surface thereof and a space defined by the partition; and a radiator disposed on the partition of the carrier. The space is formed in a region of the surface of the carrier excluding a region required to support the radiator. Therefore, influence of the carrier is minimized so that the radiation performance may be improved.

9 Claims, 4 Drawing Sheets

(a)

(b)

(a)

(b)

(a)

(b)

INTERNAL ANTENNA MODULE AND WIRELESS COMMUNICATION APPARATUS HAVING THE SAME

CLAIM OF PRIORITY

This application claims the benefit of the earlier filing date, pursuant to 35 USC 119, to that patent application entitled "INTERNAL ANTENNA MODULE AND WIRELESS COMMUNICATION APPARATUS HAVING THE SAME" filed in the Korean Intellectual Property Office on Dec. 8, 2008 and assigned Serial No. 10-2008-0123750, the contents of which are incorporated herein by reference.

BACKGROUND OF THE INVENTION

1. Field of the Invention

The present invention relates generally to an internal antenna module and a wireless communication apparatus having the same.

2. Description of the Related Art

With the rapid advances in information-communication technology, wireless communication apparatuses providing various services to users through wireless data communication have been widely deployed. Examples of such devices are a PCS (Personal Communication Service), a DCS (Digital Cellular System), GPS (Global Positioning System), a PDA (Personal Digital Assistant), a cellular phone, a Smart Phone, a laptop computer, and a palmtop computer. The wireless communication apparatus is gradually miniaturized, lightweight, and thin, and the variety of functions thereof must meet the needs of customers.

Generally two types of antennas may be used as an element of a wireless communication apparatus to improve transceiver sensitivity. A road or whip external antenna, which protrudes from the wireless communication apparatus by a preset length, is one type of antenna that is used. However, such external antennas are very fragile, have a poor design and inferior portability. Therefore, built-in antennas, so-called internal antennas, which are mounted in the wireless communication apparatus, are also used.

FIG. 1 (represented as FIG. 1(*a*) and FIG. 1(*b*)) illustrates a general internal antenna module, wherein FIG. 1(*a*) illustrates a carrier 10 mounted on a main board (not shown) of a wireless communication apparatus and FIG. 1(*b*) illustrates an antenna module including a plate-shaped radiator 20 installed on a surface of the carrier 10.

A carrier 10 provides a preset gap between a main board, that is, a Radio Frequency (RF) board, and the radiator 20 to achieve a desired radiation performance and serves as a supporting member protecting the radiator 20 from an external impact and mitigating the effect of such an impact. The radiator 20 is made of a metal plate and is attached to a surface of the carrier 10.

The carrier 10 is coupled with the radiator 20 in such a way that a plurality of protrusions 11 of the carrier 10 is inserted into a plurality of holes 21 of the radiator 20 and is thermally welded.

When a surface of the carrier 10 is closely attached to the radiator 20, since the carrier 10 has a permittivity of 2.8 to 3, three times that of air, an efficiency of the radiator 20 is deteriorated and, thus, it is difficult to guarantee a desired radiation performance of an antenna module.

SUMMARY OF THE INVENTION

The present invention provides an internal antenna module and a wireless communication apparatus having the same, in which a space is formed in a region excluding a region required to support a radiator in a carrier while keeping the antenna module thin so that radiation performance of the antenna module may be improved.

The present invention provides an internal antenna module comprising: a carrier including a partition formed on a surface thereof and a space defined by the partition; and a radiator disposed on the partition of the carrier. The space has sides surrounded by the partition and an opening facing the radiator.

The space is formed in a region of the surface of the carrier excluding a region to support the radiator, or at a position corresponding to a signal input portion and a signal output portion of the radiator. This is because influence of the dielectric carrier is strongest at a signal input portion and a signal output portion of the radiator.

For the coupling and fitting of the radiator and the carrier, the internal antenna module further includes a plurality of protrusions formed on the top of the partition and a plurality of holes formed in the radiator to accommodate the plurality of protrusions.

In accordance with another aspect, the present invention also provides a wireless communication apparatus including the above-mentioned internal antenna module.

According to the present invention, a space is defined in a region of the carrier excluding a region required to support the radiator on the surface on which the radiator is mounted, while maintaining an existing thickness of the carrier. Therefore, influence of the carrier on the radiator is minimized so that radiation performance of the internal antenna module may be improved.

BRIEF DESCRIPTION OF THE DRAWINGS

The objects, features and advantages of the present invention will be more apparent from the following detailed description in conjunction with the accompanying drawings, in which.

DETAILED DESCRIPTION

Exemplary embodiments of the present invention are described in detail with reference to the accompanying drawings. The same reference symbols are used throughout the drawings to refer to the same or like parts. Detailed descriptions of well-known functions and structures incorporated herein may be omitted to avoid obscuring the subject matter of the present invention.

Figure 2:
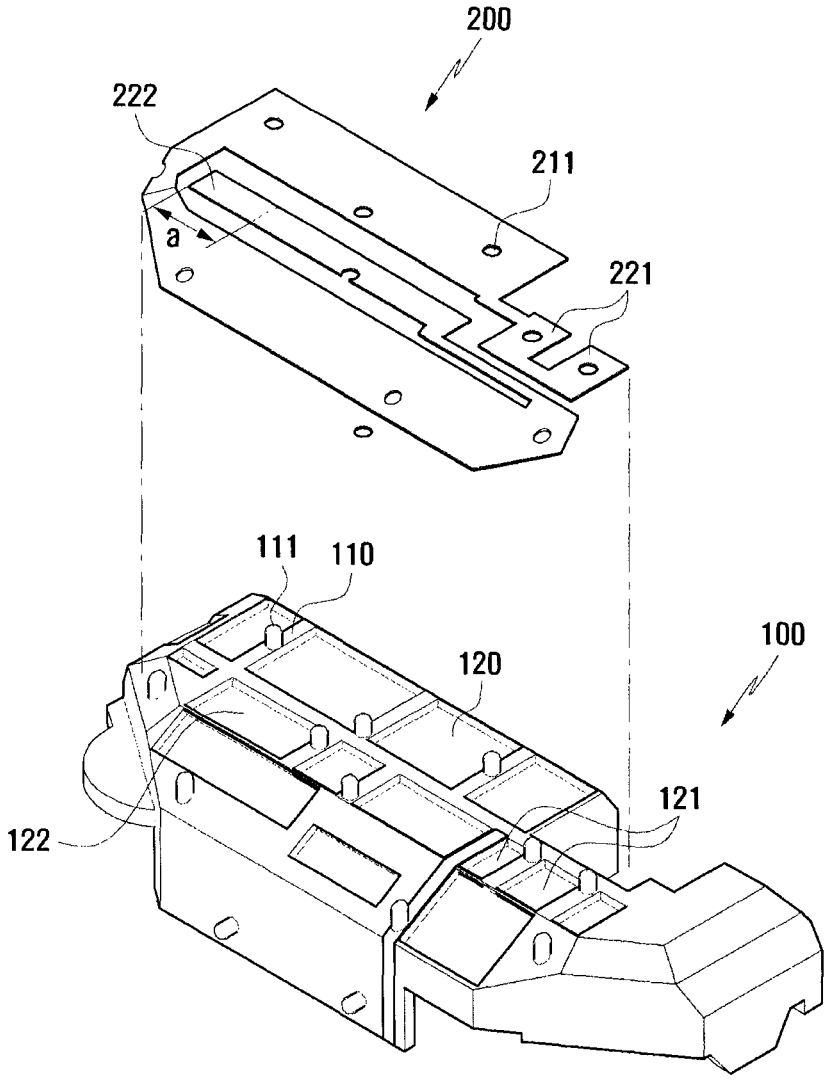
FIG. 2 is an exploded perspective view illustrating an internal antenna module according to an exemplary embodiment of the present invention.
Figure 3:
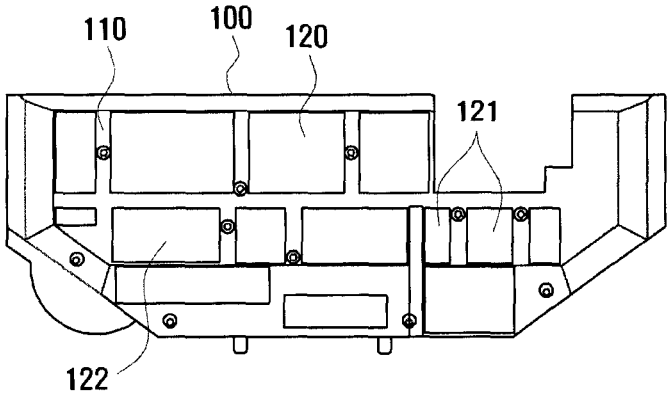
FIGS. 3(*a*)/3(*b*) represent views illustrating a carrier of the internal antenna module according to the exemplary embodiment of the present invention.
Figure 3:
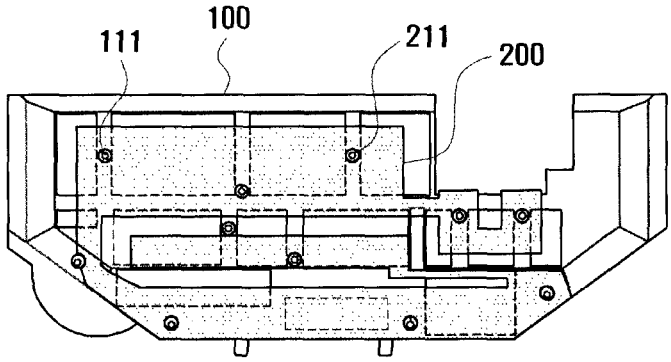

FIG. 2 is an exploded perspective view of an internal antenna module according to an exemplary embodiment of the present invention. FIG. 3(*a*) is a plan view of a carrier of the internal antenna module according to the exemplary embodiment of the present invention and FIG. 3(*b*) is a plan view of the internal antenna module according to the exemplary embodiment of the present invention.

Referring to FIGS. 2 and 3(*a*)/3(*b*), an internal antenna module according to an exemplary embodiment of the present invention includes a carrier 100 mounted on a main board of a wireless communication apparatus (not shown) and a radiator 200 mounted on a surface of the carrier 100. The carrier 100 is made of non-conductive synthetic resin, particularly, polycarbonate. Polycarbonate possesses excellent weatherability, impact resistance, and mechanical strength. However, it would be understood that other types of materials may be used without altering the scope of the invention claimed. The radiator 200 represents a Planar Inverted F Antenna (PIFA) having a power feed point and a ground point provided in a single plate radiator, and may be applied to a variety of dipole antennas having a ground point.

Figure 1:
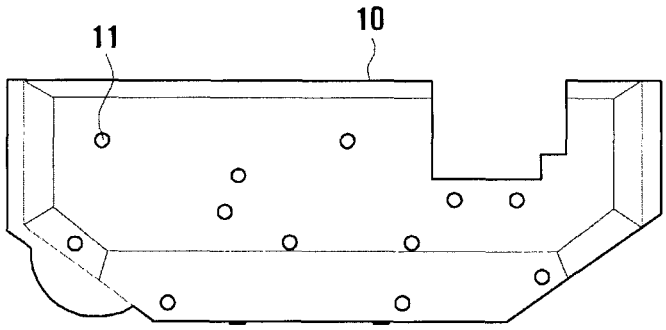
FIGS. 1(*a*)/1(*b*) represent views illustrating an existing internal antenna module.
Figure 1:
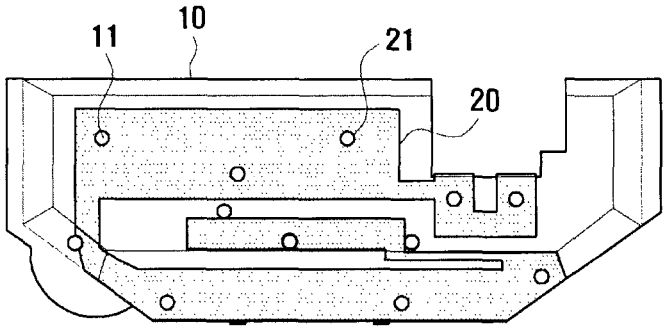

The carrier 100 includes a partition 110 provided on a surface on which the radiator 200 is mounted and a space 120 defined by the partition 110. The carrier 100 has the same thickness as that of the previously described existing carrier 10 (see FIG. 1(*a*)). Therefore, the space 120 of carrier 100 on which the radiator 200 of the carrier 100 is mounted is obtained by partially protruding or removing the resin that forms the existing carrier 10 by a preset height or depth from a surface of the existing carrier 10. That is, the space part 120 has sides surrounded by the partition 110 and an opening facing the radiator 200.

Since the space 120 is formed to employ air as a dielectric, the space 120 may be formed in every remaining region excluding a minimal region of the carrier 100 required to support the radiator 200. The region supporting the radiator 200 becomes the partition 110. Meanwhile, since a signal input portion and a signal output portion have the greatest influence on the radiation efficiency of the radiator 200, the carrier 100 may have spaces 121 and 122 formed at positions corresponding to the signal input portion 221 and the signal output portion 222 of the radiator 200. A plurality of protrusions 111 is formed on the top of the partition 110 to couple and fix the radiator 200 to the carrier 100.

The radiator 200 is electrically connected to the main board and includes a plurality of holes 211 accommodating the protrusions 111 for the coupling and fixation with the carrier 100.

The internal antenna module according to the present invention is manufactured by the following method. The carrier 100 including the partition 110, the space 120, and the protrusions 111 on a surface thereof is made by injection molding of non-conductive synthetic resin. In this case, the carrier 100 has the same overall thickness as that of the existing carrier. That is, the carrier 100 is made by removing material from the existing carrier to form space part 120. Also, the radiator 200 having the holes 211 is obtained by pressing sheet metal.

Then, the radiator 200 is put on the partition 110 of the carrier 100. A side of the radiator 200 faces the opening of the space 120. The coupling and fixation between the carrier 100 and radiator 200 may be achieved by fitting the protrusions 111 on top of the partition 110 into the holes 211 of the radiator 200. Not all of the plurality of protrusions 111 is accommodated in the holes 211 and other protrusions, excluding the protrusions inserted into the holes 211, may be arranged at the installation positions of the radiator to support the radiator 200.

Thermal welding, performed by heating and pressing the carrier 100 and the radiator 200 together and coupled with each other as described above, is performed such that the protrusions 111 inserted into the holes 211 may be melted and the radiator 200 may be fixed to the carrier 100. As such, the protrusions 111 are accommodated in the holes 211 to couple and fix the radiator 200 to the carrier 100 by the thermal welding process.

Figure 4:
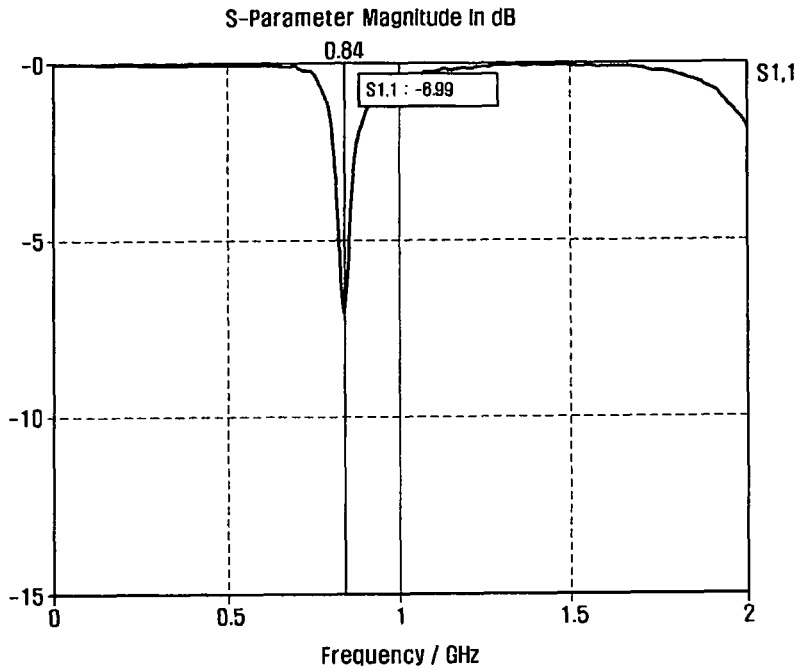
FIGS. 4(*a*)/(*b*) represent graphs illustrating simulation results and comparative data of the internal antenna module according to the exemplary embodiment of the present invention.
Figure 4:
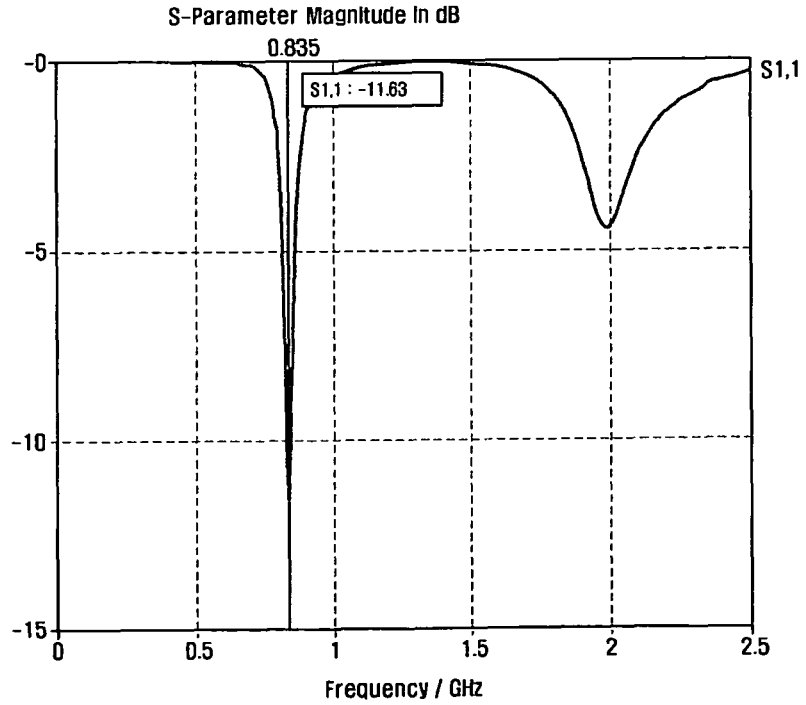

FIG. 4 illustrates the comparison of simulated data of the internal antenna module according to the exemplary embodiment of the present invention with those of an existing internal antenna module. FIG. 4A is a graph illustrating simulation results of the internal antenna module using an existing carrier (comparative example) and FIG. 4B is a graph illustrating simulation results of the internal antenna module according to the exemplary embodiment of the present invention (present invention). The simulations were carried out using Micro-Wave Studio (MWS®) by Computer Simulation Technology AG (CST AG).

Referring to FIG. 4, S-parameter (S1, 1) at resonant frequency (800 MHz) is −6.99 dB in the comparative example and −11.63 dB in the present invention. In general, since an antenna only has an input port except for a multi-port, only the S-parameter (S1,1) is output. The S-parameter (S1,1) indicates the reflection loss expressed by a ratio of reflection over input and shows a behavior such as a sharp drop at the resonant frequency. The sharp drop of the S-parameter (S1,1) at the resonant frequency means that an input voltage is not reflected at the resonant frequency but is discharged as much as possible. Therefore, the sharper the drop in the S-parameter (S1,1), the better is the radiation performance. As illustrated in FIG. 4, since the S-parameter (S1,1) drops more sharply in the present invention than in the comparative example, it can be understood that the present invention has improved radiation performance.

The comparison results of radiation efficiency and gain in the present invention with the comparative example are listed in the following table.

TABLE 1

| | Comparative example | Present invention |
|---|---|---|
| Efficiency (%) | 70.88 | 86.16 |
| Gain (dBi) | 1.523 | 1.689 |
| Resonant frequency | 840 MHz | |

As listed in Table 1, the radiation efficiency is improved by about 16% and the gain is increased by 0.166 dBi in the present invention in comparison with the comparative example. Furthermore, outputs are calculated from the efficiencies.

$$10 \log(0.7) = -1.55 \text{ dBi} \quad (1)$$

$$10 \log(0.86) = -0.66 \text{ dBi} \quad (2)$$

Since the output of −1.55 dBi in the comparative example is obtained from equation 1 and the output of −0.66 dBi in the present invention is obtained from equation 2, the output in the present invention is increased by 0.9 dBi.

As described above, in the internal antenna module according to the present invention, the radiation efficiency is improved in comparison to that of the existing internal antenna module. This improvement is the result of the reduction of the influence of the radiator 200 on the permittivity of the carrier 100 due to the space 120 formed in the carrier 100. When the influence on the permittivity of the carrier 100 is reduced, it is necessary to tune the length of the radiator 200 during design of the internal antenna module.

$$L \propto \frac{1}{\sqrt{\varepsilon \cdot \mu}}, \quad (3)$$

where L is length, ∈ is the permittivity, and μ is the transmittance.

As expressed in equation 3, the length of the radiator is inversely proportional to the square root of the permittivity and, the length of the radiator is slightly increased when the influence of the permittivity is reduced. It can be understood that the internal antenna module according to the exemplary embodiment of the present invention shown in FIG. 2 is tuned at the end of the radiator 200 by a preset length "a." The experimentally tuned length a is about 4 mm and has no influence on the overall size of the antenna module.

Although, in the above-mentioned description of the internal antenna module of the present invention and the manufacturing method thereof, the carrier and the radiator are coupled with each other by fitting the protrusions into the holes and thermally welding the same, the present invention is not limited to this coupling mechanism. It will be appreciated by those skilled in the art that a general coupling mechanism may be applied to the internal antenna module of the present invention.

A wireless communication apparatus including the above-mentioned internal antenna module falls within the spirit and scope of the present invention. Mounting the antenna module to the wireless communication apparatus may be accomplished by a mechanism generally employed in the art. There are several types of wireless communication apparatuses to which the internal antenna module of the present invention is applicable. For example, the internal antenna module described by be incorporated into devices such as a cellular phone, a smart phone, a personal digital assistant (PDA), a laptop device, a palmtop device, a global positioning system (GPS), and the like.

Meanwhile, it will be appreciated by those skilled in the art that the present invention is not limited to wireless communication apparatuses but may be applied to all fields employing internal antenna modules.

The exemplary embodiments of the present invention are provided for the easy description and understanding of the present invention with specific examples but do not limit the scope of the present invention. It will be appreciated by those skilled in the art that various changes and modifications may be practiced without departing from the spirit of the present invention.

What is claimed is:

1. An internal antenna module comprising:

a carrier including a partition formed on a surface thereof and a first space defined by the partition and a bottom surface of the carrier comprised of a same material as the partition; and a radiator disposed on the partition of the carrier;

wherein a second space and a third space are formed at respective positions corresponding to a signal input portion and a signal output portion of the radiator, wherein a length of the radiator is tuned according to a dielectric effect of at least one of the respective first, second and third spaces on the permittivity of the carrier, and wherein the first space is formed in a region of the carrier excluding a region required to support the radiator in the carrier, wherein the first space has sides surrounded by the partition and the bottom surface of the carrier, and the first space has an opening facing the radiator.

2. The internal antenna module of claim 1, further comprising:

a plurality of protrusions formed on the top of the partition; and a plurality of holes formed in the radiator to accommodate the plurality of protrusions.

3. The internal antenna module of claim 1, wherein a length of the radiator is tuned according to:

$$L \propto \frac{1}{\sqrt{\varepsilon \cdot \mu}},$$

where L is length, ∈ is the permittivity, and μ is the transmittance.

4. A wireless communication apparatus comprising an internal antenna module comprising:

a carrier including a partition formed on a surface thereof and a first space defined by the partition and a bottom surface of the carrier comprised of a same material as the partition; and a radiator disposed on the partition of the carrier, wherein a top of the radiator is substantially parallel to a top surface of the carrier;

wherein a second space and a third space are formed at respective positions corresponding to a signal input portion and a signal output portion of the radiator, wherein a length of the radiator is tuned according to a dielectric effect of at least one of the respective first, second and third spaces on the permittivity of the carrier, and wherein the first space is formed in a region of the carrier excluding a region required to support the radiator in the carrier.

5. The wireless communication apparatus of claim 4, wherein a length of the radiator is tuned according to:

$$L \propto \frac{1}{\sqrt{\varepsilon \cdot \mu}},$$

where L is length, ∈ is the permittivity, and μ is the transmittance.

6. An antenna configuration comprising:

a carrier element including a first space recessed within a top surface of the carrier element; the first space further comprising at least one partition element surrounding an open space and a bottom surface of the carrier comprised of a same material as the partition, the open space extending through the carrier element; and a radiator disposed within the first space, wherein a top of the radiator is substantially parallel to a top surface of the carrier element;

wherein a second space and a third space are formed at respective positions corresponding to a signal input portion and a signal output portion of the radiator, wherein a length of the radiator is tuned according to a dielectric effect of at least one of the respective first, second and third spaces on the permittivity of the carrier, and wherein the first space is formed in a region of the carrier excluding a region required to support the radiator in the carrier.

7. The antenna configuration of claim 6 further comprising:

a plurality of protrusions extending from the at least one partition; and a plurality of holes within the radiator corresponding to the plurality of protrusions.

8. The antenna configuration of claim 6, wherein the first space has sides surrounded by the partition and an opening facing the radiator.

9. The antenna configuration of claim 6, wherein a length of the radiator is tuned according to:

$$L \propto \frac{1}{\sqrt{\varepsilon \cdot \mu}},$$

where L is length, ∈ is the permittivity, and μ is the transmittance.

* * * * *